United States Patent [19]

Connolly et al.

[11] 4,401,030

[45] Aug. 30, 1983

[54] PORTABLE MARKING TOOL

[75] Inventors: John E. Connolly, Wyoming; Mark D. Huggett, Battle Creek, both of Mich.

[73] Assignee: Gator Manufacturing, Inc., Battle Creek, Mich.

[21] Appl. No.: 273,510

[22] Filed: Jun. 15, 1981

[51] Int. Cl.[3] ..... B41F 1/06; B41F 17/00

[52] U.S. Cl. ..... 101/316; 101/41; 101/4

[58] Field of Search ..... 91/173, 184, 189 A; 101/41, 42, 43, 44, 4, 9, 27, 316; 227/130; 173/134, 135

[56] References Cited

U.S. PATENT DOCUMENTS

| | | | |
|---|---|---|---|
| 2,546,114 | 3/1951 | Triplett et al. | 173/134 X |
| 2,995,113 | 8/1961 | Steiner | 227/130 X |
| 3,067,724 | 12/1962 | Jenney et al. | 227/130 X |
| 3,208,353 | 9/1965 | Wandel | 91/442 X |
| 3,762,484 | 10/1973 | Speicher | 101/3 R X |
| 4,077,319 | 3/1978 | Edmisten | 101/41 |

*Primary Examiner*—Edgar S. Burr
*Assistant Examiner*—Charles A. Pearson
*Attorney, Agent, or Firm*—Fisher, Gerhardt, Crampton & Groh

[57] ABSTRACT

A portable marking tool having a cylindrical housing and a concentric cylinder slidably supporting the hammer member for delivering an impact to a marking die. A charge of air is built up in the housing which is suddenly imposed on the piston-like hammer member when the charge of air is built up to overcome a predetermined opposing load. In one embodiment, the opposing load is afforded by a pressure regulated chamber and in another embodiment by an adjustable spring load.

8 Claims, 4 Drawing Figures

10
69
68
20
74
48
44
42
45
50
46
47
26
76
36
52
38
12
49
24
34
72
62
64
66
54
16
14
22
40
28
27
32
19
18
80
82
84

PORTABLE MARKING TOOL

This invention relates to marking tools for impressing identifying indicia on workpieces made of metal or other hard materials.

Most marking tools are large and cumbersome requiring mounting in a stationary position and movement of the workpiece to be marked to the location of the tool. Also various air operated marking tools have been developed but most such arrangements require complicated air circuits and control valves in order to provide a marking tool which will apply sufficient and sudden force to make a mark in a workpiece and which also will return the tool to its initial position in readiness for marking a subsequent mark.

An object of the invention is to provide a marking tool in which a charge of air is substantially instantaneously applied to a member to strike the marking die and make an imprint in the workpiece.

It is another object of the invention to provide a portable marking tool employing simple circuitry and valving.

Yet another object of the invention is to provide a portable marking tool which can utilize sources of compressed air which normally are readily available.

The objects of the invention are accomplished by a marking tool which has a cylindrical housing member with a smaller coaxially disposed cylinder communicating with the interior of the housing. A movable wall is disposed in the housing and has a piston portion which closes the open end of the cylinder. A hammer member is disposed within the cylinder to strike a marking assembly including a marking die. The movable wall forms a first chamber which is subject to a predetermined pressure and a second chamber at the other side of the wall which is selectively placed under the influence of pressure to overcome the pressure in the first chamber until the piston is displaced to open the end of the cylinder causing the charge of air in the second chamber to be imposed on piston-like hammer member to drive it into abrupt contact with the marking assembly. With the marking assembly held against a workpiece, the impact between the hammer and marking assembly causes the imprint. The mechanism is returned to its original position in readiness to make a second mark automatically by equalization of pressures in the second, third and fourth chambers by way of a bleed passage formed in the hammer member between the third and fourth chambers. The build up of the charge of air required to move the hammer member is under the control of a resistance chamber, the pressure in which must be overcome by the pressure being built up for the charge which subsequently is delivered to accelerate the hammer member. In a second embodiment of the invention, build up of the charge of air is under the control of an adjustable spring force.

These and other objects of the invention are accomplished by the embodiments disclosed in the following description and illustrated in the drawings in which.

Figures 1, 2, 3, 4:
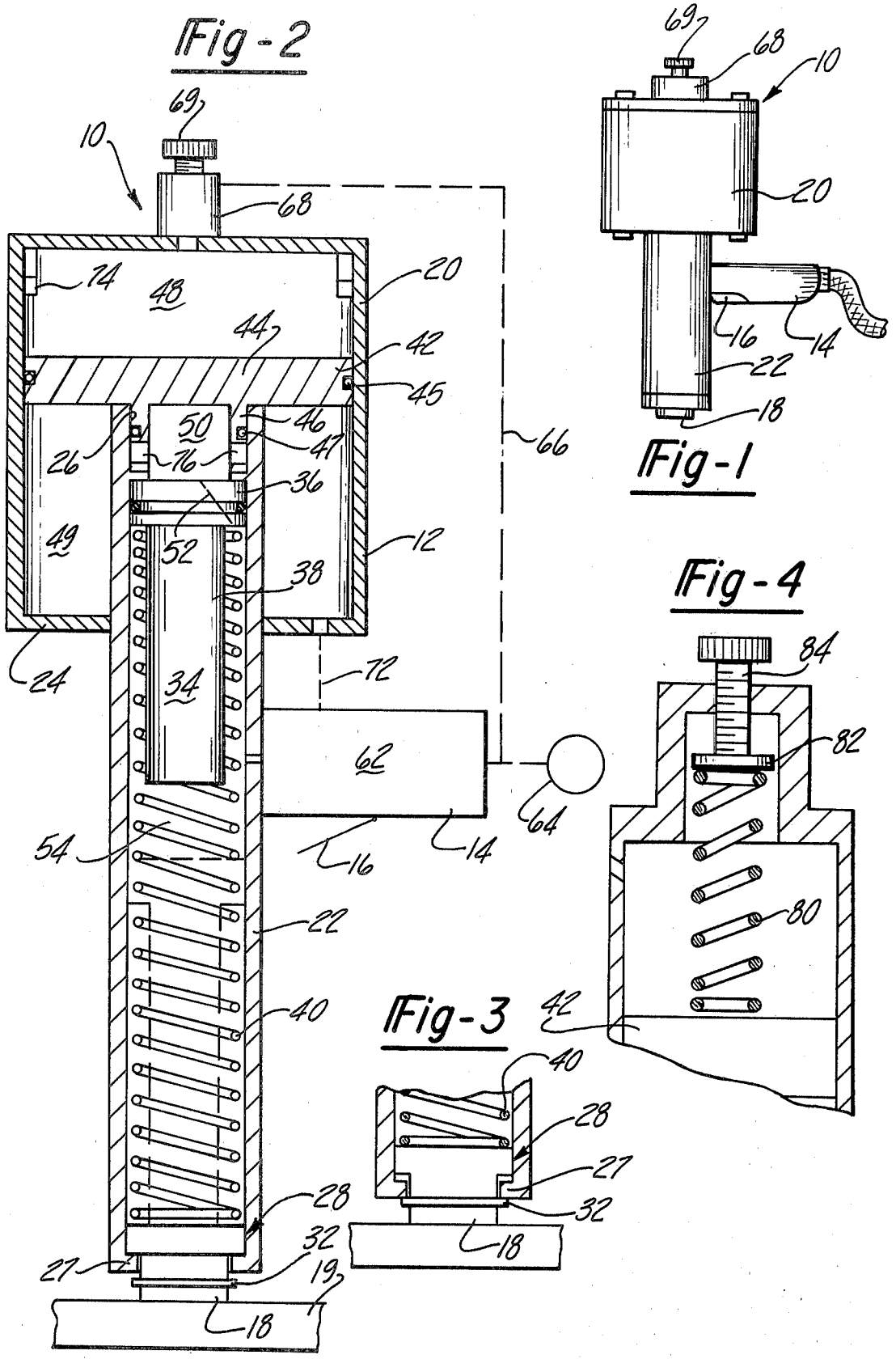
FIG. 1 is a side elevation of the portable marking tool embodying the invention.
FIG. 2 is a diagrammatic cross-sectional view of the marking tool in FIG. 1.
FIG. 3 is a cross-sectional view of the lower portion of the marking tool seen in FIG. 2.
FIG. 4 is a fragmentary view similar to FIG. 2 showing another embodiment of the invention.

Referring to the drawings, a portable marking tool embodying the invention is designated generally at 10 and includes a body member 12 having a handle 14 for holding the marking tool in position, an actuating trigger 16 and a marking die 18 which serves to make a permanent mark on the workpiece such as that indicated at 19 and usually made of metal or some other hard substance.

The body member 12 includes a cylindrical housing 20 and an elongated coaxial cylinder 22 passing through an end wall 24 of the housing 20 to present an open end 26 within the interior of the housing 20.

The end of the cylinder 22 opposite the open end 26 has an annular flange 27 which supports a flanged marking member 28. The member 28 and marking die 18 form a marking assembly which is supported to move a limited axial amount through the opening formed by the annular flange 27 between the limits determined by an annular collar or stop 32 exterior of the cylinder 22. The cylinder 22 also slidably supports a hammer member 34 in the form of a piston 36 and rod portion 38. The hammer member 34 and marking assembly 28 are biased in opposite directions from each other by a coil spring 40 which is only strong enough to overcome the weight of the hammer member 34.

The cylindrical housing 20 slidably supports a movable wall 42 having a first piston portion 44 with an annular seal 45 sealingly engageable with the interior walls of the housing 20 and a second, smaller piston portion 46 having an annular seal 47 normally seated in and closing the open end 26 of the cylinder 22. The smaller piston portion 46 is formed by an annular collar protruding from the underside of the piston portion 44.

With the second or smaller piston portion 46 in the position illustrated in the drawings and closing the open end 26 of the cylinder 22, the movable wall 42 divides the housing into a first pressure chamber 48 at one side of the movable wall 42 and a second smaller annular chamber 49 at the other side of the movable wall between the annulus defined by the interior wall of the housing 20 and the exterior wall of the cylinder 22. With the parts disposed in the positions shown in the drawings, a third chamber 50 is formed within the annular collar or piston portion 46 and to one side of the piston 36 of the hammer unit 34. The third chamber 50 is in continuous communication by means of a bleed passage 52 with an atmospheric pressure chamber 54 disposed between the hammer member 34 and the marking assembly 28 within the cylinder 22. The bleed passage 52 is a restricted cross section and permits the equalization of pressures in the chamber 50 and 54 without seriously detracting from the effect of a charge of air under pressure being applied to the upper side of the piston portion 36.

The handle 14 which is attached to the body member 12 houses a valve 62 which is actuated by a trigger 16. The valve 62 is a simple on-off valve by which air under pressure can be introduced into the chamber 49 from a supply of air pressure in the form of a reservoir or the like indicated at 64. Preferably the pressure in the reservoir 64 is the order of 60 to 100 PSI. Reservoir 64 is used also to supply air through a line 66 to a pressure reducing valve 68 mounted on the housing 20 to communicate with the chamber 48. The pressure regulating valve 68 may be set in a conventional manner to a predetermined pressure level by adjusting a screw type control 69.

Under normal operating conditions, when the portable marking tool 10 has been placed in readiness for use by connecting it to a source of air pressure such as the reservoir 64, chamber 54 will be at atmospheric pressure which is made available to the interior of the cylinder 22 through the loosely fitting marking assembly 28 at the lower end of cylinder 22. Atmospheric pressure also will exist in the chamber 50 due to bleed passage 52 communicating with atmospheric pressure chamber 54. Under such circumstances, coil spring 40 will urge the marking assembly 28 downwardly as seen in the drawings against annular flange 27 and will urge the hammer member 34 upwardly to its initial position.

The chamber 48 will be at a pressure determined by the setting of the pressure reducing valve 68 which can be adjusted by the rotatable control element 69. It has been found that an operating pressure of approximately 50 PSI in the chamber 48 is suitable. This pressure serves to urge and to maintain the movable wall 42 so that the small piston portion 46 is in the open end 26 of the cylinder 22 with seal 47 in engagement with the inner wall of the cylinder 22 and separating the pressures in chambers 49 and 50.

With the portable marking tool 10 under the pressure conditions described above, that is, an elevated pressure in chamber 48 and atmospheric pressure in the remaining chambers, marking of a workpiece can begin. This is accomplished by placing and pressing the die 18 of the marking assembly 20 against a workpiece 19. This causes the marking assembly 28 to move axially so that stop 32 abuts flange 27 as seen in FIG. 3 and slightly compresses the spring 40. Upon depressing the trigger 16 to open valve 62, line pressure from reservoir 64 will be introduced through a line 72 to the chamber 49. When the force of the pressure in chamber 49 acting on the annular area defined by the piston portion 44 between the seal 45 on internal wall of the housing 20 and the seal 47 on the inner surface of cylinder 22 reaches a sufficiently high level to overcome the pressure in chamber 48, the movable wall 42 will begin moving upwardly as seen in the drawing. This requires a pressure in chamber 49 substantially greater than the pressure existing in chamber 48 because of the differential in areas. After the movable wall 42 moves a distance sufficient to move the seal 47 beyond the end of cylinder 22, the air charge which has been built up in chamber 49 acts on the entire underside surface of the larger piston portion circumscribed by seal 45 to move the wall 42 upwardly against an annular stop 74. The charge of air in high pressure chamber 49 is suddenly made available in the chamber 50 by way of openings 76 in annular piston portion 46. This propels the hammer member 34 downwardly at a high rate of speed against the minimum resistance of the relatively weak coil spring 40 and the friction of seal 47. Toward the end of its stroke, the hammer member 34 strikes the marking assembly 28 to move it from its position illustrated in FIG. 3 a short axial distance to the position illustrated in FIG. 2 at which time the hammer member 34 will be in the position illustrated in broken line. This action causes an imprint to be made in the workpiece 19 against which the marking assembly 28 has been held.

The bleed passage is of small cross section to restrict the flow of large volumes of air. As a consequence, the application of a charge of high pressure air to the piston 36 is not seriously affected by the continuously open bleed passage 52.

Immediately after marking has been accomplished and with trigger 16 released to close valve 14, pressures in the chambers 49 and 50 tend to equalize with the chamber 54 through means of the bleed passage 52. This permits the pressure in chamber 48 to return the movable wall 42 to the position in which it is illustrated and as the pressures in the chambers 50 and 54 continue to equalize, the hammer member 34 is moved to its original position and the marking tool 10 is again in readiness for making another mark.

In a second embodiment of the invention illustrated in FIG. 2, all of the parts remain essentially the same except that the function of the pressure chamber 48 is eliminated by opening it to the atmosphere and a spring 80 is substituted to resist movement of the movable wall 42. The spring 80 acts between the movable wall 42 and has its opposite end seated against seat element 82 movable axially of the body member 12 by means of a screw element 84. By adjusting the screw element 84 to selected axial positions, the loading of the spring 80 can be varied thereby varying the amount of pressure required to move the movable wall 42 to the right before the chambers 49 and 50 communicate with each other and bring about movement of the hammer member 34.

The operation of the second embodiment of the invention is essentially the same as that of the earlier described embodiment in that pressure is introduced to the chamber 49 to move the movable wall 42 against the resistance offered by the spring 80 until the chamber 50 is opened into the chamber 49 after which the hammer member 34 is moved downwardly to strike the marking assembly tool 28.

Both of the embodiments of the invention result in a portable marking tool which can be easily moved to the location of a workpiece to be marked and both of which use a relatively readily available power source, namely, compressed air at a relatively low pressure.

The embodiments of the invention in which an exclusive property or privilege is claimed are defined as follows:

1. A portable marking tool comprising: a cylindrical housing member, a cylinder disposed coaxially with said housing and having an open end communicating with the interior of said housing, a movable wall member disposed for movement in said housing and having a piston slidable in said cylinder to open and close communication with said housing, a marking assembly supported at an end of said cylider for limited axial movement and including a movable marking element engageable with the workpiece to be marked, a piston member in said cylinder and having a rod portion normally disposed in spaced relationship to said marking element for movement into engagement therewith, said movable wall forming a first chamber at one side of said movable wall and a second annular chamber at the other side of said wall within said housing and outside of said cylinder, said piston member forming a third chamber in said cylinder between said piston member and said piston of said movable wall when said movable wall is in a position closing the open end of said cylinder, a fourth chamber being formed in said cylinder between said piston member and said marking member in communication with the atmosphere, passage means placing said fourth chamber in continuous communication with said third chamber, means for maintaining a charge of fluid at a predetermined constant pressure in said first pressure chamber except during movement of said movable wall, supply means for selectively delivering pressure to said second pressure chamber to move said movable wall against the resistance of said charge of fluid in said first chamber and slide said piston portion outwardly relative to said open end to place said second pressure chamber and third pressure chamber in communication with each other to move said piston member to strike against said marking member to mark a workpiece, and means consisting of said charge of fluid in said first chamber to return said movable wall to a position wherein said piston portion recloses said open end of said cylinder.

2. The portable marking tool of claim 1 and further comprising resilient means urging said marking assembly and piston member in opposite directions.

3. The portable marking tool of claim 2 wherein said resilient means is a coil spring having opposite ends engaging said marking assembly and said piston member.

4. The portable marking tool of claim 3 wherein said coil spring imposes a force no greater than necessary to maintain said piston member in an initial position in said cylinder when the pressures at opposite sides of said piston are equal.

5. The portable marking tool of claim 1 wherein said passage means is a restricted orifice permitting restricted fluid flow between said third and fourth chambers.

6. The portable marking tool of claim 1 wherein said predetermined pressure in said first pressure chamber is less than the pressure in said supply means.

7. The portable marking tool of claim 1 wherein said means for maintaining a charge of fluid at a predetermined pressure is a valve manually adjustable to selected pressure values.

8. The portable marking tool of claim 1 wherein said passage means placing said third and fourth chambers in communication with each other is a passage formed in said piston member, said passage having a restricted cross section to prevent free flow of large volumes of air.

* * * * *